United States Patent [19]

Raasch

[11] Patent Number: 4,964,054

[45] Date of Patent: Oct. 16, 1990

[54] METHOD FOR CHANGING SLIVER CANS AT A STATION OF A TEXTILE MACHINE

[75] Inventor: Hans Raasch, Moenchen-Gladbach, Fed. Rep. of Germany

[73] Assignee: W. Schlafhorst & Co., Fed. Rep. of Germany

[21] Appl. No.: 283,154

[22] Filed: Dec. 12, 1988

[30] Foreign Application Priority Data

Dec. 12, 1987 [DE] Fed. Rep. of Germany ..... 3742252

[51] Int. Cl.[5] ..... D01H 9/18; G06F 13/02

[52] U.S. Cl. ..... 364/470; 364/468; 364/478; 19/159 A; 57/264

[58] Field of Search ..... 364/468, 470, 478; 19/159 A, 239, 240; 57/264, 276, 281, 90

[56] References Cited

U.S. PATENT DOCUMENTS

| | | | |
|---|---|---|---|
| 3,922,642 | 11/1975 | Tooka | 364/470 |
| 4,150,534 | 4/1979 | Raasch | 19/159 A |
| 4,537,018 | 8/1985 | Tooka | 57/276 |
| 4,688,300 | 8/1987 | Langen et al. | 19/159 A |
| 4,735,040 | 4/1988 | Pircher | 19/159 A |

FOREIGN PATENT DOCUMENTS

| | | | |
|---|---|---|---|
| 0056469 | 5/1981 | Japan | 19/159 A |

*Primary Examiner*—Jerry Smith
*Assistant Examiner*—Paul Gordon
*Attorney, Agent, or Firm*—Shefte, Pinckney & Sawyer

[57] ABSTRACT

A method for exchanging cans of sliver at a work station of a textile machine which handles sliver includes interrogating the work station to determine the presence of an interruption in the sliver handling operation, generating a signal to indicate the presence of an interruption, interrogating the work station concerning the availability of sliver and the proper feed of sliver and generating a follow-up signal after the generation of the sliver signal if the work station is again operating after a sliver can exchange has been executed in response to a signal indicating the non-availability of sliver or an improper feed of sliver. The method optimizes the use of the sliver can transporter which transports fresh sliver cans to the work stations, by eliminating unnecessary movements of the transporter. Depending upon the responses of the work station to the interrogatories concerning the availability of sliver and the proper feed of sliver, one can determine whether merely an interruption of the sliver feed has occurred or if the interruption occurred due to the emptying of a can of sliver, in which case a delivery of a fresh sliver can to the interrogated work station can be arranged upon the next movement of the sliver can transporter. According to one aspect of the method, a summation of the empty cans of the interrogated work stations is maintained and the sliver can transporter is sent on another transport cycle only when the summation of empty sliver cans equals a predetermined number preferably corresponding with the maximum complement of fresh sliver cans which the transporter can carry. According to another aspect of the method, the time elapsed since the sliver was first withdrawn from the replaced sliver can at the interrogated work station is monitored and the count of empty sliver cans is increased if the elapsed time exceeds a predetermined maximum operating time.

14 Claims, 2 Drawing Sheets

METHOD FOR CHANGING SLIVER CANS AT A STATION OF A TEXTILE MACHINE

BACKGROUND OF THE INVENTION

The present invention relates to a method for changing cans at a station of a textile machine. More particularly, the present invention relates to a method for changing sliver cans at a plurality of work stations of a textile machine at which stations the sliver is continuously drawn from the cans.

In German Patent No. 25 35 435, a method is disclosed for exchanging sliver containers at a plurality of spinning stations of a spinning machine including moving a container transport apparatus along the spinning stations. The transport apparatus is loaded with full sliver containers and circulates among the spinning stations. Upon receipt of a signal "sliver absent" from a spinning station, the transport apparatus halts at the signal-emitting spinning station and exchanges empty sliver containers at the station for full sliver containers. The method disclosed in German Patent No. 25 36 435 enables the can exchange process to be a completely automatic process at least up to the point at which the sliver from the full cans is received by the spinning stations. However, this process still has room for improvement because, among other reasons, the constant back and forth movement of the transport apparatus with the full sliver cans thereon requires a significant amount of energy and can complicate the control and operation of the textile machine. Accordingly, the need exists for a method for changing sliver cans at the spinning stations of a textile machine which provides the opportunity to reduce energy costs and to simplify control and operation of the textile machine.

SUMMARY OF THE INVENTION

The present invention provides a method for exchanging cans of sliver at a work station of a textile machine, the work station having sensing means for sensing the operating conditions thereat including the availability and feed of sliver and reporting the operating conditions to a data processing means, comprising interrogating the work station to determine the presence of an interruption in the sliver handling operation, generating a signal to indicate if an interruption is present, interrogating the work station concerning the availability of sliver and the proper feed of sliver, generating a sliver signal if the work station reports, in response to the interrogating the work station concerning the availability of sliver and the proper feed of sliver, that no sliver is available or that the sliver feed is not proper, whereby an operation to exchange the sliver can from which the sliver was previously drawn for another can containing sliver can be initiated, interrogating the work station, after generating the sliver signal, to determine the operating status of the work station, and generating a follow-up signal in response to interrogating the work station after generating the sliver signal if the work station is again operating, whereby the follow-up signal can be interpreted as an indication that an exchange of an empty sliver can for a can containing sliver has occurred. Preferably, the method also includes generating a signal identifying the work station at which the interruption has occurred.

In one modification of the method of the present invention, the method includes maintaining a summation of the follow-up signals, comparing the summation to a predetermined value following each increase in the summation due to the generation of another follow-up signal and generating a delivery signal, whereby a delivery of fresh sliver cans can be initiated in response to the delivery signal.

In another modification of the method of the present invention, the method includes determining the time elapsed since the sliver was first withdrawn from the replaced sliver can and increasing a count of empty sliver cans if the elapsed time exceeds a predetermined maximum operating time.

The present invention provides a method for optimizing the use of the sliver can transporter by eliminating unnecessary movements. The method of the present invention permits the can transporter to transport a full compliment of full sliver cans and to deliver these cans at those work stations at which a can exchange has occurred while simultaneously retrieving a similar number of empty cans from these work stations.

If the feed of sliver to a work station of a textile machine is interrupted, the operation of the work station accordingly experiences an interruption of its operation. If the individual work stations of the textile machine are provided with sensors which sense the operations at the work stations and the sensors are connected to a central computer or controller of the textile machine, an interruption signal, which indicates the operating condition of the respective interrupted work station, can be generated. For example, a signal can be generated by the sensor which senses the availability of the sliver if the sensor senses that the sliver is no longer available.

An operating condition signal, which indicates an interruption at the work station as well as the absence of sliver feed, can be generated to indicate the particular work station at which the interruption is occurring so that the interruption can be eliminated. If the interruption is eliminated and the controller or computer receives both a signal indicating the sliver is feeding normally and a signal indicating the work station is operating properly, one can assume that the interruption has been eliminated. For example, the interruption may have been eliminated through the exchange of a full sliver can for an empty sliver can at the respective work station. After the generation of the following sequence of signals: (1) signal indicating interruption of the feed of the sliver; (2) signal indicating the absence of sliver feed; and (3) signal indicating the resumption of the operation of the sliver feed, a follow-up signal can be generated which indicates that an empty sliver can has been exchanged for a full sliver can. Preferably, the receipt of this follow-up signal can be taken as an indication that an empty sliver can at the previously interrupted work station has been exchanged for a full sliver can and, accordingly, that an empty can is now in the reserve row. The exchange of cans can be manually executed or can be accomplished by means of an automatic can exchange apparatus such as that described above.

By the present invention a command to the sliver can transporter to deliver cans to the respective work stations is given once the predetermined number of follow-up signals have been received and the follow-up signal counter is reset to zero to begin a new counting cycle. It is also contemplated that the controller or computer can subtract one unit from a predetermined count upon each receipt of a follow-up signal and transmit a delivery signal to the sliver can transporter once the predetermined count has been reduced to zero.

The method of the present invention also provides the capability to transmit a sliver feed signal to the controller or computer which indicates the availability of sliver at a particular work station and also indicates that the sliver is feeding normally at the work station. In this respect, a sensor can be provided to determine the availability of sliver and generate a signal component indicating the sliver availability as well as a sensor for sensing the proper feeding of the sliver to the work station and generating an additional signal component to indicate the proper feeding. If both signal components are positive, that is, if one signal component indicates that sliver is available and the other indicates that the sliver is feeding properly, the two signal components can be combined and delivered to the controller as a signal indicating the proper availability and feed of sliver. On the other hand, if sliver is available yet not feeding properly at the work station due to, for example, a sliver blockage at the drawing apparatus of an open end spinning machine, a signal indicating the absence of sliver can be transmitted to the controller. Similarly, if no sliver is available at a work station, the signal component indicating the availability of sliver will be absent and a corresponding signal transmitted to the controller will indicate this condition.

In accordance with the method of the present invention, the availability of sliver at a work station can be sensed, for example, by a patrol apparatus which periodically examines each work station and eliminates interruptions thereat. To facilitate the proper feeding of sliver at a work station, sensors such as, for example, mechanical sensors or a periodically present patrol apparatus, can be provided. In this respect, a roller can be provided which is caused to roll upon engagement by the moving sliver so that a rotation counting sensor assembly connected to the roller can generate a signal indicating the proper feeding of sliver at a work station. If the sliver feed at a work station is interrupted, the roller accordingly will not be rotated and the signal component indicating the proper feeding of sliver will be absent. Then, in accordance with the method of the present invention, a sliver can exchange at the affected work station can be undertaken.

In the event that a signal is generated indicating both the non-availability of sliver and the absence of feeding of sliver at a work station, the controller or computer can be programmed to prevent the patrol apparatus from attending to the work station. Since the patrol apparatus cannot remedy an interruption of this nature, it is preferable to prevent such unnecessary trips. This approach is advantageous in certain operations such as, for example, open end spinning operations since it serves no purpose to attempt to restart the spinning process each time an indication is received that sliver is not available.

DETAILED DESCRIPTION OF THE PREFERRED EMBODIMENTS

Figure 1:
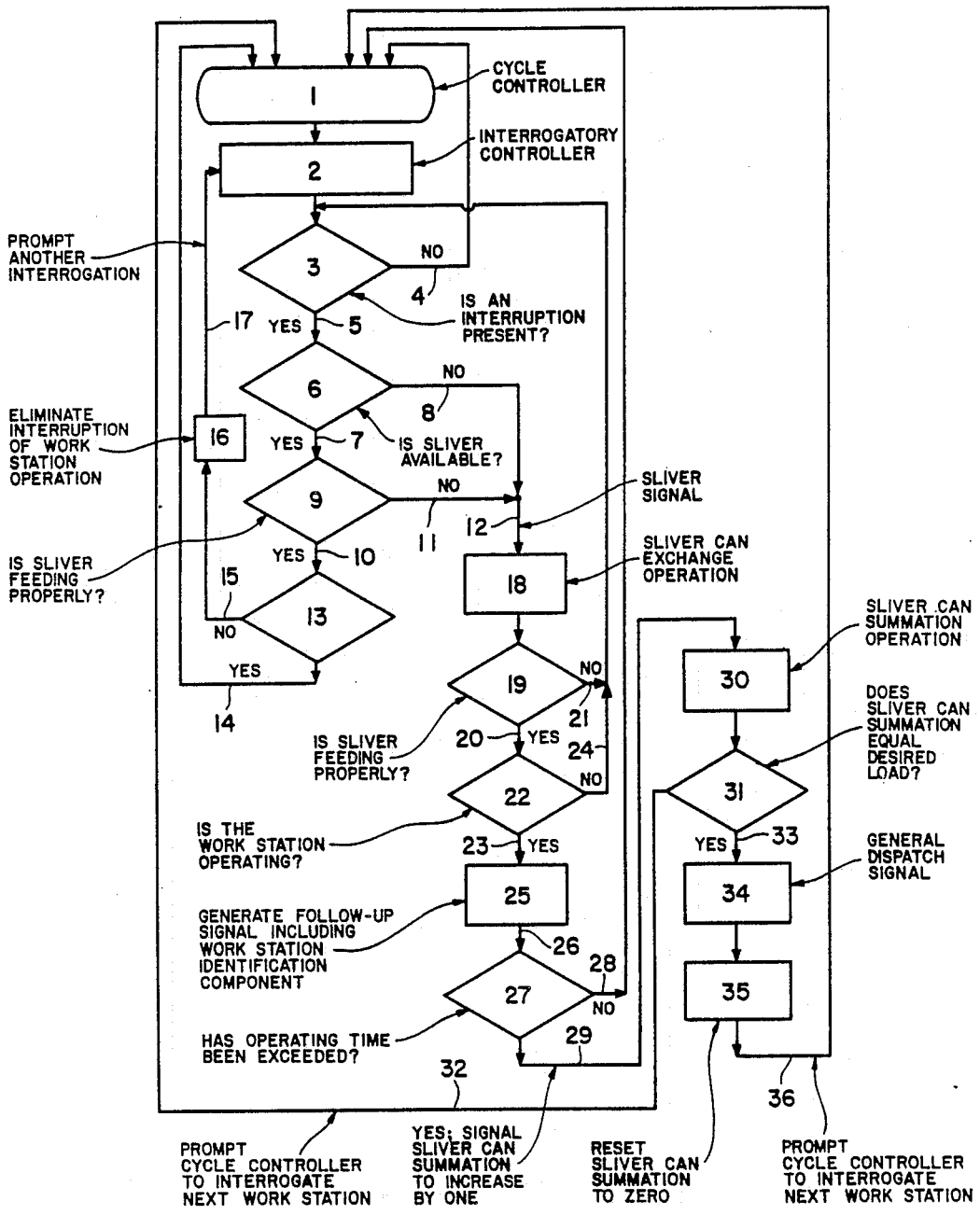
FIG. 1 is a schematic representation of the method of one preferred embodiment of the present invention.

In FIG. 1, the possible signals and queries which can be received from and directed to the work station of a textile machine in accordance with the method of one preferred embodiment of the present invention is schematically illustrated. To implement the method of the present invention, a central computer can be provided to receive and interpret signals relating to the operating condition of individual work stations of one or several sliver processing textile machines. The computer can be programmed to implement the method illustrated in FIG. 1 which includes a cycle controller 1 which determines the individual work station to which a cycle of interrogatories are directed. An interrogatory controller 2 controls the cycle of interrogatories at the selected work station and the interrogatories can be directed to the individual work stations in a systematic, computer controlled operation or by a patrol apparatus which periodically visits the individual work stations.

Figure 2:
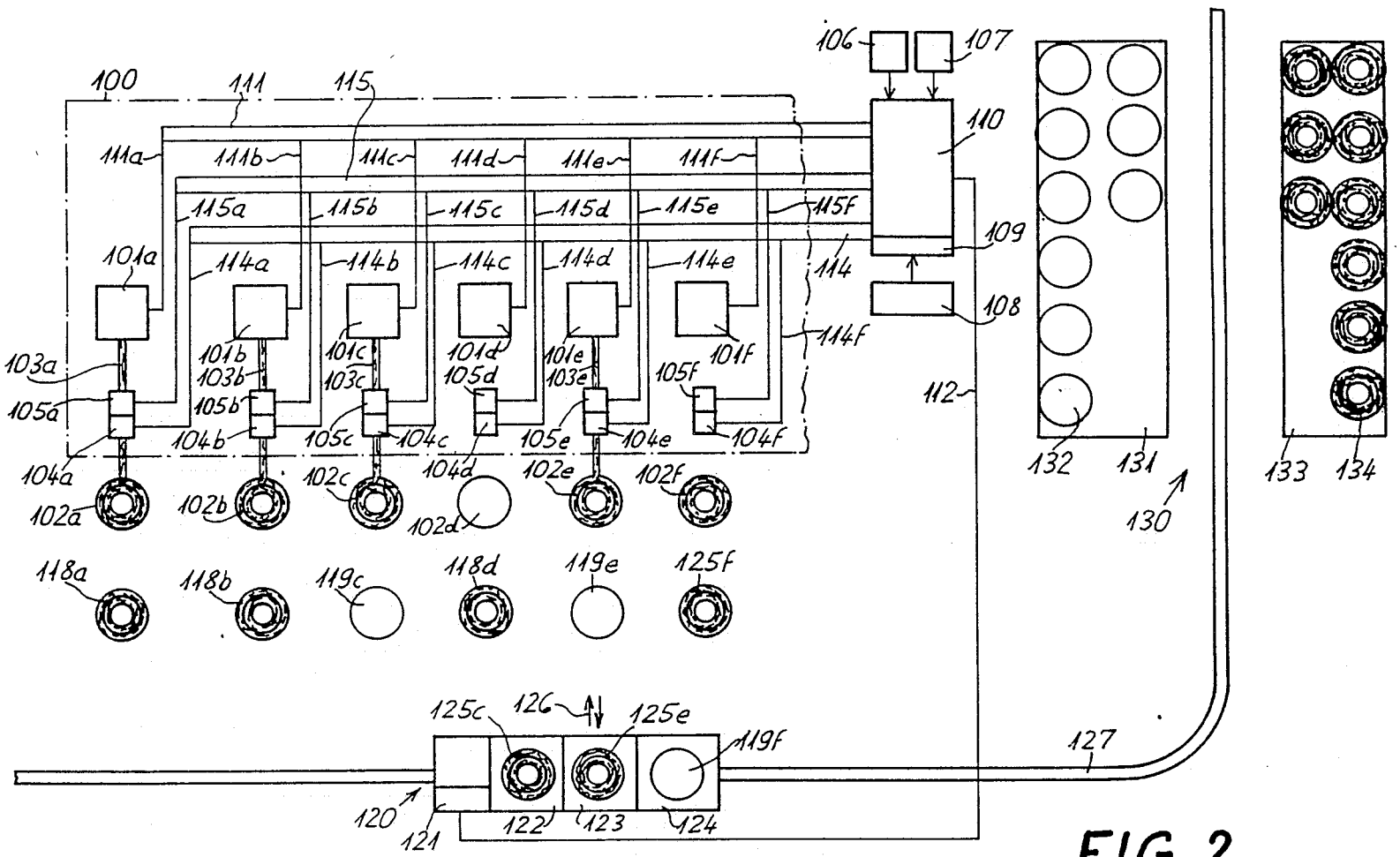
FIG. 2 is a schematic representation of the conventional components of a textile machine for implementing the method of the present invention.

In FIG. 2, the conventional components of a textile machine capable of implementing the method of the one preferred embodiment of the present invention are schematically illustrated. A conventional textile machine such as, for example, a spinning machine 100, includes a plurality of work stations 101*a*–101*f*. Each work station 101*a*–101*f* includes a conventional spin box which operates in conventional manner to draw in a sliver 103*a*–103*f*, respectively, from a sliver can 102*a*–102*f*, respectively, positioned adjacent each respective spin box.

Each work station 101*a*–101*f* is operatively connected by a conventional connector 111*a*–111*f*, respectively, to a conventional central computer 110. Additionally, each work station 101*a*–101*f* is provided with a conventional sensor 104*a*–104*f*, respectively, for sensing the availability of sliver at the respective work station. The sliver availability sensors 104*a*–104*f* are operatively connected via a plurality of conventional connectors 115*a*–115*f*, respectively, to the central computer 110. Each work station 101*a*–101*f* is additionally provided with a conventional sensor 105*a*–105*f*, respectively, for sensing the proper feeding of sliver from the respective sliver can 102*a*–102*f* to the spin box of the work station. The sliver feeding sensors 105*a*–105*f* are operatively connected via a plurality of conventional connectors 115*a*–115*f*, respectively, to the central computer 110. The sliver availability sensors 104*a*–104*f* and the sliver feeding sensors 105*a*–105*f* sense the respective slivers 103*a*–103*f* traveling from the respective sliver cans 102*a*–102*f* to the spin boxes of the respective work stations 101*a*–101*f*.

A plurality of reserve sliver cans are located at a sliver can reserve location adjacent the row of sliver cans 102*a*–102*f*, such as representatively illustrated by the sliver cans 118*a*, 118*b*, and 118*d* and are aligned with the respective sliver cans 102*a*–102*f*, for exchange therewith. A conventional sliver can transport wagon 120 travels along a guided route 127 in conventional manner to deliver a load of fresh sliver cans such as, for example, fresh sliver cans 125*c*, 125*e* and 125*f*, from a conventional sliver can loading station 130 to a location adjacent the sliver can reserve location and to transport empty sliver cans such as representatively shown by the sliver cans 119*c*, 119*e* and 119*f*, from the sliver can reserve location to the sliver can loading station 130. The traveling sliver delivery wagon 120 includes a number of positions 122, 123 and 124 for individually supporting sliver cans on the wagon and the positions 122–124 are operatively connected in conventional manner to a conventional sliver can counter 121 mounted on the wagon 120 to signal the sliver can counter 121 concerning the presence of a sliver can on the respective position. The sliver can 121 is operatively connected by a conventional connector 112 to the central computer 110.

The sliver can loading station 120 includes conventional means (not shown) for transferring fresh sliver cans 134 from a fresh sliver can loading apparatus 133 onto the traveling sliver can delivery wagon 120 and conventional means (not shown) for removing empty sliver cans such as, for example, the empty sliver can 119*f* transported on the position 124 of the traveling sliver can transport wagon 120 to dispose the empty sliver can with other empty sliver can with other empty sliver cans 132 on a conventional sliver can loading system 131.

A conventional cycle input means 106 is operatively connected to the central computer 110 for controlling the central computer to sequentially interrogate the work stations 101*a*–101*f*. A conventional input means 107 is operatively connected to the central computer 110 for providing elapsed time data to the central computer 110. A conventional input means 108 is operatively connected to a conventional empty sliver can counter 109 which is, in turn, operatively connected to the central computer 110. The input means 108 provides information to the central computer 110 concerning the sliver can carrying capacity of the traveling sliver can delivery wagon 120.

It is in the conventional environment of the apparatus and operation of FIG. 2 that the subject matter of the preferred embodiment of the present invention is practical as described otherwise herein.

An interrogatory step 3 is implemented at the work station to determine the presence of an interruption. If no interruption of the sliver intake operation is present, an operating condition signal 4 is generated which indicates that no interruption is present and this signal is transmitted to the cycle controller 1, which then performs an indexing operation to implement an interrogatory cycle at another work station. In the event that the work station responds to the interrogatory step 3 with a signal 5 indicating the presence of an interruption, the work station is interrogated by an interrogatory step 6 as to the availability of sliver at the work station. The determination that sliver is available at the work station can be accomplished, for example, by sensors disposed at the work station or by sensors on the patrol apparatus which can be moved to the work station being interrogated.

If the sensors determine, in response to the interrogatory step 6, that sliver is available, an interrogatory step 9 is implemented at the work station to determine the proper feeding of sliver thereto. To respond to the interrogatory step 9, the work station can be provided with sensors such as, for example, optical, capacitative or mechanical sensors. Similarly, sensors can be provided on the patrol apparatus which monitor the sliver feed. In this respect, the patrol apparatus can be provided with a roller which can be moved into engagement with the sliver. Appropriate sensing apparatus connected to the roller can be provided to generate a signal 10 in response to the detection of rotation of the roller during its engagement with the sliver, indicating the proper feeding of sliver.

If a signal 10 is generated indicating that the sliver feed is proper, the work station is interrogated during an interrogatory step 13 to determine whether the work station is operating. If the work station is operating, a signal 14 is generated and transmitted to the cycle controller 1 to cause the cycle controller to direct a cycle of interrogatories to the next work station. If the station is not operating, a signal 15 is generated in response to the interrogatory step 13 and the signal 15 is interpreted as a command to execute a interruption eliminating operation 16. Once the interruption eliminating operation 16 has been completed and the interruption has been eliminated, a signal 17 is generated to cause the interrogatory step controller 2 to again interrogate the now operating work station with the interrogatories step 3, 6, 9 and 13.

A sliver signal 12 is comprised of a first component which indicates that the sliver feed is proper and a second component which indicates that the sliver is available. The absence of first component is indicated as 11 and the absence of the second component is indicated as 8. If the sliver feed is not proper, one signal component of the signal 12 will be absent. If a sliver signal 12 is generated without the signal component whose absence is indicated by 11, a sliver can exchange 18 is undertaken at the interrogated work station.

On the other hand, if the response to the interrogatory step 6 regarding the availability of sliver is that there is no sliver available, the second component of the sliver signal 12 is not generated and this absence of the second component is indicated by 8. The transmission of the sliver signal 12 with the absence of one of its components, in this case the second component, causes the can exchange operation 18 to occur so that a fresh can is exchanged for the empty can at the work station.

After the can exchange operation 18 has been completed at the work station, the work station is interrogated during an interrogatory step 19 to determine if the sliver is feeding and this can be determined by corresponding sensors. If the sliver is feeding, a signal 20 is generated to indicated that the sliver is now feeding. Simultaneously with the interrogating of the work station during the interrogatory step 19, the work station is interrogated by an interrogatory step 22 to determine if the station is operating. If the work station is operating, a follow-up signal 23 is generated and is interpreted as an indication that an exchange of a full can for an empty can has occurred at the work station.

In contrast, if the sliver is not feeding, a signal 21 will be generated in response to the interrogatory step 19. Likewise, if the station is not operating, a signal 24 will be generated in response to the interrogatory step 22. Each signal 21 or 24 causes a new interrogatory cycle, beginning with the interrogatory step 3 concerning the presence of an interruption, to be initiated at the same work station.

The follow-up signal 23 includes a component 25 identifying the particular work station at which the can exchange operation has just occurred. The identification component 25 and the follow-up signal 23, when combined, comprise a follow-up signal 26 which initiates an interrogatory step 27 to determine if the operating time of the identified work station has been exceeded. Specifically, the computer compares the time which has elapsed since the work station has first drawn in sliver from the sliver can with a predetermined operating time based upon such factors as the type of material being handled, the desired product and the dimensions of the sliver cans as well as a predetermined tolerance range of times based upon the average operating times of other sliver cans.

If the actual time does not exceed the predetermined operating time, the follow-up signal 26 is ignored and a signal 28 is generated to prompt the cycle controller 1 to index to the next work station to be interrogated.

On the other hand, if the interruption of the work station occurred when the elapsed operating time falls within the range of tolerance time comprising the end of the predetermined operating time, a signal 29 is transmitted to cause a sliver can counting operation 30 to increase its summation of empty sliver cans by one.

Each time the can counting operation 30 registers yet another empty sliver can, an interrogatory step 31 is implemented to determine whether the number of empty sliver cans equals a predetermined number which corresponds, for example, to the number of full sliver cans that are in a full compliment of cans loaded on the can transporter. If the response to the interrogatory step 31 is that the predetermined number of cans has not yet been reached, a signal 32 is transmitted to the cycle controller 1 to cause another work station to be interrogated. On the other hand, if the number of empty sliver cans equals the predetermined number of cans 33, a can delivery signal 34 is generated to initiate the delivery of fresh, full cans to the respective work stations which have generated interruption signals and have had can exchange operations thereat. If a can delivery operation 34 is initiated, a reset operation 35 is initiated thereafter to reset the can counter 30 to zero and to generate a signal 36 to the cycle controller 1 to prompt the interrogation of further work stations.

The flow diagram of FIG. 1 relates to a single work station. It is contemplated that the other work stations will be interrogated in the same manner.

The method of the present invention enables one to monitor the operating condition of individual work stations of a textile machine and to automatically cause an exchange of cans at the work stations when such an exchange is required and thereby avoid unnecessary transport and transfer operations by the sliver can transporter.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A method for exchanging cans of sliver at a work station of a textile machine which handles sliver, the work station having sensing means for sensing the operating conditions thereat including the availability and feed of sliver and reporting the operating conditions to a data processing means, comprising:

interrogating the work station to determine the presence of an interruption in the sliver handling operation;

generating a signal to indicate if an interruption is present;

interrogating the work station concerning the availability of sliver and the proper feed of sliver;

generating a sliver signal if the work station reports, in response to said interrogating the work station concerning the availability of sliver and the proper feed of sliver, that no sliver is available or that the sliver feed is not proper, whereby an operation to exchange the sliver can from which the sliver was previously drawn for another can containing sliver can be initiated;

interrogating the work station, after said generating said sliver signal, to determine the operating status of the work station;

generating a follow-up signal in response to said interrogating the work station after said generating said sliver signal if the work station is again operating, whereby said follow-up signal can be interpreted as an indication that an exchange of an empty sliver can for a can containing sliver has occurred and;

determining the time elapsed since the sliver was first withdrawn from the replaced sliver can and increasing a count of empty sliver cans if said elapsed time exceeds a predetermined maximum operating time.

2. A method for exchanging cans of sliver at a work station according to claim 1 and characterized further by generating a signal identifying the work station at which the interruption has occurred.

3. A method for exchanging cans of sliver at a work station according to claim 2 and characterized further by maintaining a summation of said follow-up signals, comparing said summation to a predetermined value following each increase in said summation due to the generation of another follow-up signal, and generating a delivery signal, whereby a delivery of fresh sliver cans can be initiated in response to said delivery signal.

4. A method for exchanging cans of sliver at a work station according to claim 3 and characterized further in that said predetermined value corresponds to a desired quantity of fresh sliver cans to be delivered in response to said delivery signal.

5. A method for exchanging cans of sliver at a work station according to claim 3 and characterized further in that said maintaining a summation of said follow-up signals includes commencing a new summation from a value of zero in response to said generating a delivery signal.

6. A method for exchanging cans of sliver at a work station according to claim 1 and characterized further in that said sliver signal includes a first component if sliver is available and a second component if the feed of sliver is proper, whereby the absence of said first or second component in said sliver signal indicates, respectively, that no sliver is available or that the feed of sliver is not proper.

7. A method for exchanging cans of sliver at a work station according to claim 6 and characterized further in that said second component is generated by a sensing means at the work station in response to sensing of movement of sliver by said sensing means.

8. A method for exchanging cans of sliver at a work station according to claim 7 and characterized further in that said sensing means includes a roller rotatable in response to engagement by moving sliver and means connected to said roller for generating said second component in response to rotational movement of said roller.

9. A method for exchanging cans of sliver at a work station according to claim 1 and characterized further in that said predetermined maximum operating time is determined with respect to the material, the desired product and the capacity of the sliver cans.

10. A method for exchanging cans of sliver at a work station according to claim 1 and characterized further in that said predetermined maximum operating time is the sum of the operating time of the particular work station and a tolerance time, said tolerance time corresponding to an average of the operating times of several work stations.

11. A method for exchanging cans of sliver at a work station according to claim 1 and characterized further in that said elapsed time is determined in response to said generating of said follow-up signal.

12. A method for exchanging cans of sliver at a work station according to claim 1 and characterized further in that the data processing means ignores said follow-up signal if said follow-up signal is generated before said elapsed time exceeds said predetermined maximum operating time.

13. A method for exchanging cans of sliver at a work station according to claim 1 and characterized further in that the data processing means increases said count of empty sliver cans by a factor of one upon receipt of said follow-up signal, if said follow-up signal is generated after said elapsed time exceeds said predetermined maximum operating time.

14. A method for determining the dispatch time for dispatching a traveling sliver can delivery wagon of a textile machine to travel from a sliver can loading station to a sliver can reserve location, the traveling sliver can delivery wagon delivering a desired load numbering greater than one of fresh sliver cans to the sliver can reserve location for a complete one to one exchange of the fresh sliver cans on the sliver can delivery wagon for empty sliver cans at the sliver can reserve location, the textile machine having a data processing means and a plurality of work stations each having sensing means for sensing the operating conditions thereat including the availability and proper feed of sliver to the work station, and means for reporting the operating conditions of the work stations to the data processing means, comprising:

interrogating the work stations to determine the presence of an interruption in the sliver handling operation of any respective work station;

generating a signal to indicate if an interruption is present at a respective work station;

interrogating the respective work stations concerning the availability of sliver and the proper feed of sliver;

generating a sliver signal if the work station reports, in response to said interrogating the work station, that no sliver is available or that the sliver feed is not proper, whereby an operation can be instituted to exchange the initial sliver can from which the sliver was previously drawn for a sliver can from the sliver can reserve location;

interrogating the respective work stations, after said generating said sliver signal, to determine the operating status of the respective work station;

generating a follow-up signal in response to said interrogating the work station after said generating said sliver signal if the work station is again operating, whereby said follow-up signal can be interpreted as an indication that the source of the interruption at the respective work station was the non-availability of sliver and that such non-availability of sliver has been remedied by the exchange of said empty initial sliver can for said sliver can from the sliver can reserve location;

maintaining a summation of said follow-up signals;

comparing said summation to a predetermined whole number corresponding to the desired number of fresh sliver cans to be transported by the traveling sliver can delivery wagon from the sliver can loading station to the sliver can reserve location, said comparing said summation being executed following each increase in said summation due to the generation of another follow-up signal; and generating a dispatch signal, whereby the traveling sliver can delivery wagon is dispatched in response thereto to deliver the desired number of fresh sliver cans from the sliver can loading station to the sliver can reserve location for a complete one-to-one exchange of the fresh sliver cans for the empty initial sliver cans at the sliver can reserve location.

* * * * *